US006708826B1

(12) United States Patent
Ginsberg et al.

(10) Patent No.: US 6,708,826 B1
(45) Date of Patent: Mar. 23, 2004

(54) PACKAGED SUPPLY OF INDIVIDUAL DOSES OF A PERSONAL CARE PRODUCT

(75) Inventors: Steven Ginsberg, Montville, NJ (US); Bradford S. Grant, Bridgewater, NJ (US)

(73) Assignee: Warner-Lambert Company, LLC, Morris Plains, NJ (US)

( * ) Notice: Subject to any disclaimer, the term of this patent is extended or adjusted under 35 U.S.C. 154(b) by 0 days.

(21) Appl. No.: 10/427,047

(22) Filed: Apr. 30, 2003

(51) Int. Cl.[7] ..... B65D 83/04

(52) U.S. Cl. ..... 206/535; 206/425; 206/499

(58) Field of Search ..... 206/449, 425, 206/494, 499, 528, 532, 534, 535, 538, 539; 383/37, 38, 9

(56) References Cited

U.S. PATENT DOCUMENTS

| | | | | |
|---|---|---|---|---|
| 3,315,802 A | | 4/1967 | Lonholdt et al. | |
| 3,625,351 A | | 12/1971 | Eisenberg | |
| 3,677,866 A | | 7/1972 | Pickett | |
| 3,768,725 A | | 10/1973 | Pilaro | |
| 4,498,591 A | | 2/1985 | Smith, II | |
| 4,889,238 A | * | 12/1989 | Batchelor | 206/534 |
| 4,932,547 A | | 6/1990 | Rodriguez | |
| 5,415,276 A | | 5/1995 | Welton | |
| 5,419,437 A | * | 5/1995 | Huseman | 383/37 |
| 5,613,779 A | | 3/1997 | Niwa | |
| 5,630,546 A | | 5/1997 | Velch | |
| 5,655,653 A | | 8/1997 | Chester | |
| 5,791,540 A | | 8/1998 | Sage | |
| 5,836,444 A | | 11/1998 | Hoevel et al. | |
| 5,931,304 A | * | 8/1999 | Hammond | 206/425 |
| 6,173,838 B1 | * | 1/2001 | Brozell | 206/538 |
| 6,177,391 B1 | | 1/2001 | Zafar | |
| 6,199,698 B1 | * | 3/2001 | Hetrick et al. | 206/532 |
| 6,293,403 B1 | * | 9/2001 | Holmberg | 206/534 |
| 6,575,627 B2 | * | 6/2003 | Huseman et al. | 383/38 |

OTHER PUBLICATIONS

Barex Barrier Resins Barrier Properties; 2000 BP p.l.c.; BX555B; Feb. 2000.

Surlyn Properties & Performance Overview; 2002 E.I. du Pont de Nemours & Co.

* cited by examiner

*Primary Examiner*—Luan K. Bui
(74) *Attorney, Agent, or Firm*—Kenneth G. Lemke; Evan J. Federman

(57) ABSTRACT

A packaged supply of individual doses of a personal care product, e.g., strips of a water-soluble film that contains a pharmaceutically active material, comprises the combination of a) a tray; b) a plurality of substantially identical packets uniformly stacked in the tray, each packet having a pouch portion that holds a single dose of the product and a tab portion releasably connected to the pouch portion; c) retention means for holding the tab portions of the stacked packets in the tray; and d) a cover that is movably connected to the tray, the cover being movable between a closed position in which the stack of packets is enclosed within the tray and an open position in which the pouch portion of the topmost packet on the stack is sufficiently exposed that its front edge can be gripped, allowing the pouch portion to be pulled away from the restrained tab portion to which it is connected, thereby releasing that pouch portion from the tray.

20 Claims, 8 Drawing Sheets

PACKAGED SUPPLY OF INDIVIDUAL DOSES OF A PERSONAL CARE PRODUCT

This invention concerns a packaged supply of individual doses of a personal care product, e.g., a medication, as, for example, an oral medication that is in the form of a strip of water-soluble film that contains a pharmaceutically active material.

Personal care products can be formulated in individual dosage units, e.g., as tablets or capsules to be swallowed, as lozenges or strips of water-soluble film to be allowed to dissolve in the mouth, or as strips of bioadhesive film composition for treating wounds. Sometimes it is important that each dose be segregated from the others—i.e., that the doses not all be held in the same bottle or vial. This might be the case, for example, if the formulation can be deleteriously affected by humidity, e.g., if the formulation is hygroscopic. Also, if the form of the dosage is such that the patient could easily, and unknowingly, take two dosage units at one time, when only a single unit was prescribed, it might be desired to package each dose individually. The present invention is directed to a convenient, effective way of doing so.

According to the present invention, a packaged supply of individual doses of a personal care product is comprised of the combination of:

a) atray;

b) a plurality of substantially identical packets uniformly stacked in the tray, each packet having a pouch portion that holds a single dose of the personal care product and a tab portion releasably connected to the pouch portion;

c) retention means for holding the tab portions of the stacked packets in the tray; and d) a cover that is movably connected to the tray, the cover being movable between a closed position in which the stack of packets is enclosed within the tray and an open position in which the pouch portion of the topmost packet on the stack is sufficiently exposed that its front edge can be gripped, allowing the pouch portion to be pulled away from the tab portion to which it is connected, thereby releasing that pouch portion from the tray.

Preferably each packet is comprised of two flexible sheets that are partially laminated together so as to define a closed pocket between the sheets, in which the dose is held. Such constructions are sometimes called "blister packages." The sheets may be made, for example, of one or more layers of foil, plastic film, and/or paper. Preferably the sheets are water resistant, and they can be airtight as well. A preferred metal foil is aluminum foil. As suitable plastic films may be mentioned films made of poly(ethylene terephthalate) (PET), polyolefin, acrylonitrile polymers, and copolymers of ethylene and an ethylenically unsaturated carboxylic acid, e.g., acrylic acid. Suitable polyolefins include nucleated polypropylene, low density polyethylene, and high density polyethylene. Suitable acrylonitrile polymers include copolymers of acrylonitrile and methyl acrylate, e.g., the Barex® barrier resins. Suitable ethylene/unsaturated acid copolymers include those wherein the acid groups are partially neutralized with zinc or sodium ions, e.g., the Surlyn® packaging resins.

As suitable paper may be mentioned wax paper.

The tab portion and pouch portion of each packet may be connected by various means, e.g., by releasable adhesive strips, by hook and loop fastener strips, or by the two portions being constructed out of one sheet of material (on each side) and that material being thin enough that the pouch portion can be torn away from the tab portion. Thus, the pouch portion and tab portion can meet at a boundary zone along which the two portions can be torn apart by pulling, thereby releasing the pouch portion from the tray.

In the tear-apart embodiment, it is preferred that the boundary zone have tear-facilitating means that tend to confine the tear line to that zone when the pouch portion is tom away from the tab portion. Examples of tear-facilitating means include a score line in the sheet material, a perforated line therein, and a tear-directing notch in an edge of the packet at one or both ends of the boundary zone. If the boundary zone contains a layer of paper, preferably a perforated line will be used. If a score line or a perforated line is used, preferably it will run across the entire width of the packet. If a tear-directing notch is used, preferably two will be employed, one at each end of the boundary zone. This will make tearing as easy for lefthanders as for right-handers.

A tear-directing notch can be either a simple slit in the sheet material or a gap created by the removal of material, e.g., in a V shape.

Another way to help keep the tear line straight as it traverses across the width of the packet—i.e., keep it in the boundary zone—is to use sheet material that more easily tears in that direction than in directions perpendicular thereto. Thus, for example, the sheet material can be oriented or striated film.

In the tear-apart embodiment, preferably a minor portion of each pocket will extend into the packet's boundary zone, so that when the pouch portion is torn away from the tab portion along the boundary zone, the pocket is automatically opened along the tear line. This reduces the number of steps required to remove the pouch portion from the tray, open it, and withdraw the personal care product. A single act of tearing the pouch portion away from the tab portion serves also to open that end or edge of the pocket. Sometimes, however, if the pocket is only opened at that one edge, it may be difficult to withdraw the product. This might be the case, for example, where the product is in a form that will not easily fall out of the pocket, e.g., a strip of web material. Especially if one wants to use a thumb and forefinger to extract the product, that might be easier to do if the pocket were opened wider. To facilitate opening the pocket wider, the front edge of the pouch portion can have tear-facilitating means that enable the pouch portion, once released from the tray, to be manually torn into two segments along a second tear line, one that extends from the pouch's front edge to the tear line created when the pouch was pulled away from the tab portion. The pocket should straddle this second tear line, so that when the released pouch portion is torn in two, along that line, the pocket is further opened. Preferably the second tear line will divide the pocket into a major area and a minor area, with the major area constituting about two-thirds or more of the total area of the pocket, e.g., 75 or 80% thereof. In this way, the product will be less likely to fall out of the pocket, and maybe onto the floor, as the second tear line is being created.

In the case of a personal care product in strip form, it is preferred to locate the strip in the pocket in a position away from both tear lines, e.g., to center it in the pocket. In that way, the strip will not interfere with the tearing operation, nor will it be torn in two itself.

The packets and the pockets can be in any shape, but they will be generally easier and cheaper to manufacture if they are both rectangular.

The tray-and-cover assembly also can be in any desired shape, e.g., rectangular, oval, round, trapezoidal, triangular, or irregular. However, to conserve space the assembly preferably matches, at least approximately, the outline of the packets stacked within the tray. Since it generally is more economical to manufacture such packets in rectangular shapes, it follows that the preferred shape of the tray and cover also is rectangular.

The tray-and-cover assembly preferably is small enough and thin enough that it can readily fit in a purse or pocket. For example, it might have a thickness in the range of about 0.25 to 1 inch, a width of about 1 to 5 inches, and a length of about 1 to 5 inches. Thus, for example, the assembly might have a thickness of about 0.5 inch, a width of about 2 inches, and a length of about 3 inches.

The tray preferably has a fixed cover that partially covers one of the tray ends and has a free edge that is intermediate the two ends of the tray. The tab portions of the stacked packets, and the means that retain the tab portions in the tray, preferably both lie underneath the fixed cover. With this arrangement, the device can include a special feature that will help deter the first tear line from straying into the tab portion of a packet when the attached pouch portion is being pulled away. This feature is an elongate, downward-protruding crest member on the underside of the fixed cover. It is located above, and substantially parallel to, the boundary zone of the topmost packet on the stack. In this embodiment the fixed cover is sufficiently flexible that by thumb pressure on the top thereof, the crest member can be pressed against the stack of packets, at the boundary zone, and held there while the pouch portion is torn away. This creates a line of pressure across a substantial portion of the width of the packet, and that pressure line obstructs the tear line from passing underneath the crest member. In other words, it helps keep the tear line straight. The bottommost surface of the crest member can be flat, rounded, or pointed. This arrangement is preferable to one in which the stack of packets is at all times clamped tightly between some top member and the bottom of the tray. Use of such a clamping mechanism places some portion of the device under constant tension, thereby requiring sturdier materials and/or risking a rupture of the parts during shipping, storage, or use.

The movable cover can be slidably mounted on the tray or it can be hingedly connected thereto. If a fixed partial cover also is used, preferably an edge of the movable cover will rest against the free edge of the fixed cover when in the closed position. If a hinge is used to connect the movable cover to the tray, it can be on either side of the tray, or at an end of the tray, or, if a partial fixed cover is used, the movable cover can be hingedly connected to that, at the free edge of the fixed cover.

Preferably, the device will include latch means for releasably holding the movable cover in the closed position. Any such means can be used, including, for example, a swingable latch, a slidable latch, or an interfering-fit latch. Especially preferred is an arrangement in which the partial fixed cover is used and the movable cover is hingedly connected to the tray, for example along one of the sides or at the end opposite the fixed cover. In this arrangement the latch preferably is of such a design that it can be released by thumb pressure on the top of the fixed cover. Preferably the design is such that such downward pressure will not only cause the latch to release but also cause the movable lid to pop open. Even if it pops only slightly open, that will be beneficial, in that it will make it easier to grasp the moving edge of the cover with the tip of one's forefinger and pull the cover all the way open. Also, if the crest member feature is used, the one action of pressing down on the fixed cover with the thumb of one hand can serve to simultaneously pop open the movable cover and depress the crest member into the stack of packets, making everything ready for the topmost pocket portion to be grasped by the other hand and torn out of the container, in a substantially straight tear line.

If appropriate for the contents, the device may include child-proof latch means, i.e., a latch mechanism that requires application of two different forces at once, in order to open the movable cover. Thus, for example, in addition to the pressure-release latch on the top of the fixed cover, there can be a second pressure-release latch that has to be simultaneously activated, in order for the movable cover to be opened. The second latch may be located, for example, on one of the sides of the tray, in such a manner that, to release the movable cover, finger or thumb pressure has to be simultaneously applied to both the top of the fixed cover and the side of the tray. With such an arrangement one can grip the tray in one hand, with the thumb and forefinger on opposite sides of the tray, and, with the other hand, simultaneously press down on a cover portion with thumb pressure to release the other latch.

Any type of retention means can be used to hold the tab portions of the stacked packets in the tray. A clamping mechanism can be used, for example, or the tab portions can have one or more holes that allow the packets to be mounted on one or more posts. The posts can be attached to the bottom of the tray and/or, if they are located underneath a partial fixed cover, they can be attached to the underside of the fixed cover. Alternatively, the tab portions can be glued or adhesive-taped to the tray.

As for clamping mechanisms, they can either be normally engaged or normally nonengaged. If normally nonengaged, they can be designed so that they are engaged by throwing a lever or applying pressure, e.g., thumb or finger pressure. Thus, for example, the retention means can even be the aforementioned crest member on the underside of the tray's fixed cover. When the crest member is pressed down, onto the stack of packets, that can act to hold the tab portions of the stacked packets in the tray, while the pouch portion of the topmost packet is pulled away from the tab portion to which it is connected.

Preferably the movable cover is made of transparent plastic. In that embodiment the top surface of the pouch portion of each packet can be imprinted with the name of the personal care product, and that name will be visible even when the movable cover is closed, due to the cover being transparent. This makes it unnecessary to incur the cost of also printing the name of the product on the movable cover or, if one is used, the fixed cover.

Examples of suitable transparent plastics that can be used to make the movable cover (as well as the tray and fixed cover) are transparent polyolefins, such as homopolymers or copolymers of propylene, e.g., propylene-butylene random copolymers.

It also is preferred that ingredient information and directions for using the product be printed on the bottom surface of each packet.

The invention perhaps will be better understood by considering the accompanying drawings, which depict one illustrative embodiment of the invention.

Referring to the drawings:

FIG. 12A-1 is another side elevation view of the container and packet depicted in FIG. 1, but with the movable cover slightly open.

FIG. 12A-2 is an enlarged segment of the side elevation view of the container and packets shown in FIG. 12A-1.

FIG. 12B-1 is another side elevation view of the container and packet depicted in FIG. 1, but with the movable cover closed.

FIG. 12B-2 is an enlarged segment of the side elevation view of the container and packets depicted in FIG. 12B-1.

FIG. 13A-1 is a side elevation of an alternative container to that depicted in FIG. 1—namely, one having a second latch means to hold the movable cover closed.

FIG. 13A-2 is an enlarged segment of the side elevation view of the container shown in FIG. 13A-1.

FIG. 13A-3 is a side view of the dog 132 that is shown in FIG. 13A-2

FIG. 13A-4 is a side view of the dog 131 that is shown in FIG. 13A-2.

FIG. 13B-1 is a top view of the container shown in FIG. 13A-1.

FIG. 13B-2 is an enlarged segment of the top view of the container shown FIG. 13B-1.

FIG. 14B-1 is a perspective view of the same container shown in FIG. 14A, but after application of pressure to the dual latches has popped open the movable cover.

FIG. 14B-2 is an enlarged segment of the perspective view of the container shown in FIG. 14B-1.

Figure 8:
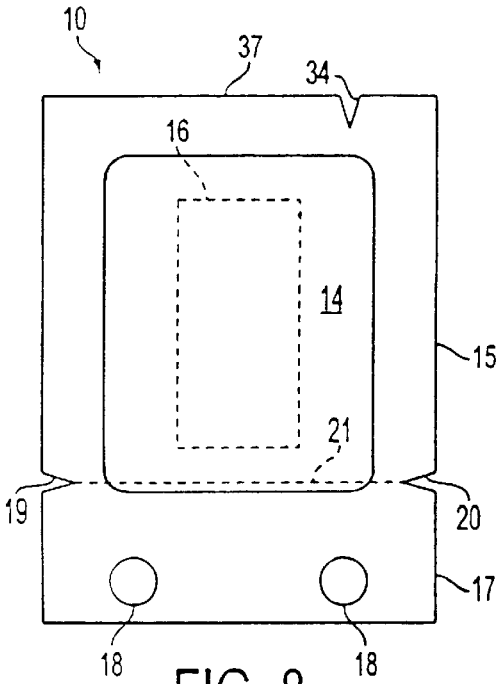
FIG. 8 is a top view of the packet depicted in FIGS. 6 and 7.
Figure 9:
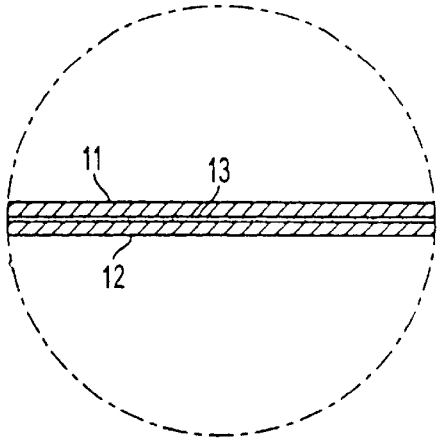
FIG. 9 is an enlarged segment of the side elevation view of the packet shown in FIG. 7.
Figure 10:
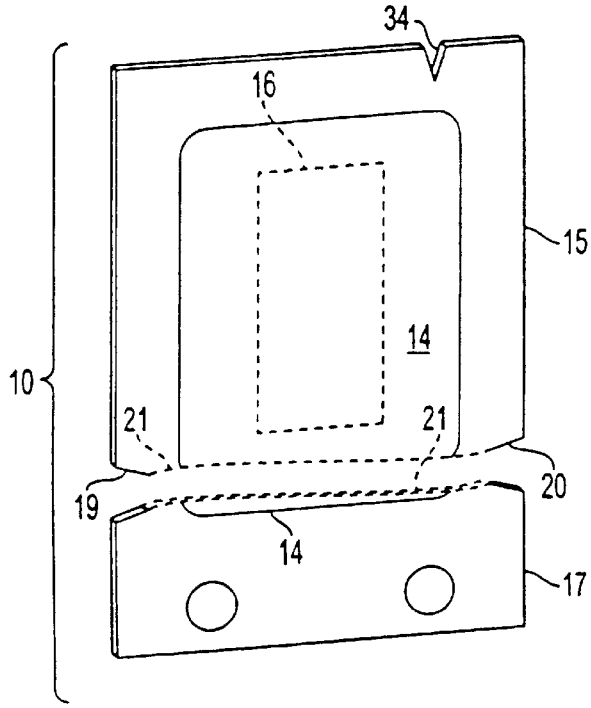
FIG. 10 is a perspective view of a packet after it has been torn in two, so as to be able to remove the pouch portion from the container.

As shown in FIGS. 6–9, each packet 10 is constructed of top and bottom sheets 11 and 12, each having a thickness of 0.004" and being made of a laminate of PET, aluminum foil, and a heat-sealable polymer. The layers of heat-sealable polymer face each other, so that the two sheets are bonded together by being heated under pressure, to a temperature at which those two coatings fuse together, forming adhesive layer 13, e.g., as shown in FIG. 9.

Figure 6:
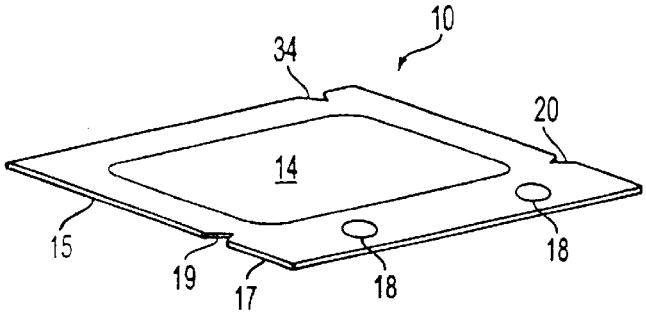
FIG. 6 is a perspective view of one of the packets.
Figure 7:
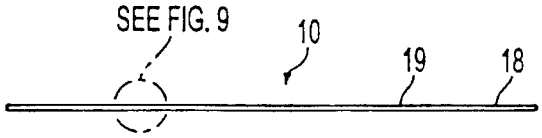
FIG. 7 is a side elevation view of the packet depicted in FIG. 6.

As depicted in FIGS. 6 and 8, adhesive layer 13 does not extend into the center area 14 of the pouch portion 15. Thus a pocket is formed between sheets 11 and 12 in the center area 14, in which a strip 16 of a personal care product is enclosed. One type of product that can be used is a medication-dosed film-forming material that dissolves in the mouth—for example, as disclosed in co-pending U.S. patent application Ser. No. 09/395,104, by Leung et al., filed Sep. 14, 1999, which is incorporated herein by reference. Such a film might contain one dose of an oral medication, e.g., an adult dose of 15 mg. of dextromethorphan, a cough suppressant, homogeneously distributed throughout the strip. Alternatively, a children's dose of 7.5 mg. can be used.

Another type of product that can be held in the pocket between sheets 11 and 12 is a wound-treating composition in the form of a film. Such films are disclosed, for example, in U.S. Pat. No. 6,329,343 B1, issued Dec. 1, 2001, which also is incorporated herein by reference.

Pouch portion 15 of each packet is connected to tab portion 17, which contains two post holes 18. V notches 19 and 20 are in the boundary zone between pouch portion 15 and tab portion 17 of the packet. The notches define an imaginary tear line 21, shown as a broken line in FIG. 8.

As shown in FIGS. 1–5, a stack of packets 10 is mounted on posts 22 in tray 23. Posts 22 extend from the inside bottom 24 of the tray to the ceiling 25 of fixed partial cover 26.

Movable cover 27 is connected to tray 23 by a living hinge 28 at the front edge of tray 23. The free edge of fixed partial cover 26 ends in a down turned lip 29. The unhinged moving edge 35 of cover 27 rests against lip 29 when cover 27 is closed.

Figure 3:
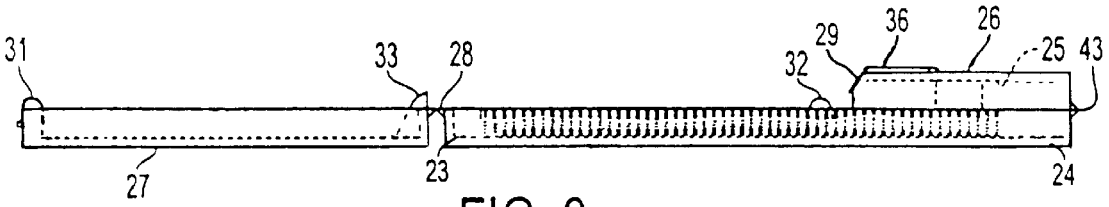
FIG. 3 is a side elevation view of the container and packets shown in FIGS. 1 and 2, but with the movable cover in the fully open position.
Figure 4:
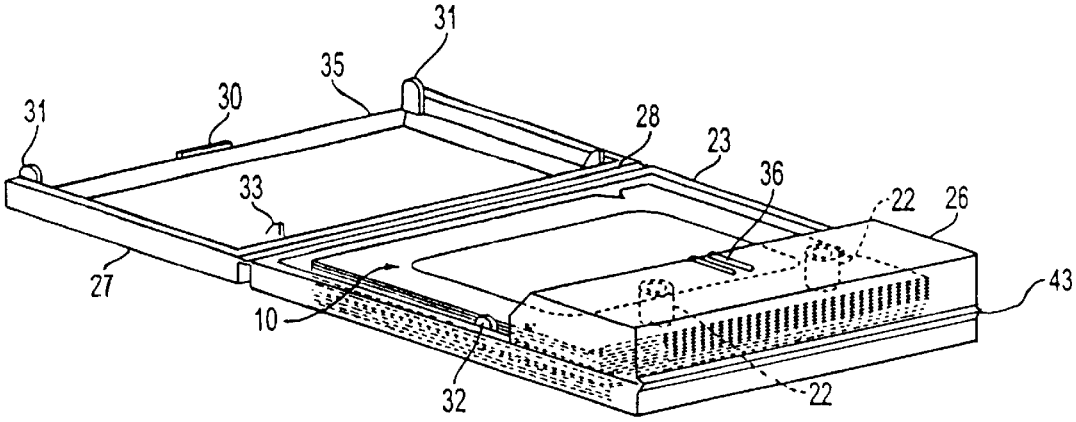
FIG. 4 is a perspective view of the container of FIG. 1 with the cover in the fully open position.
Figure 5:
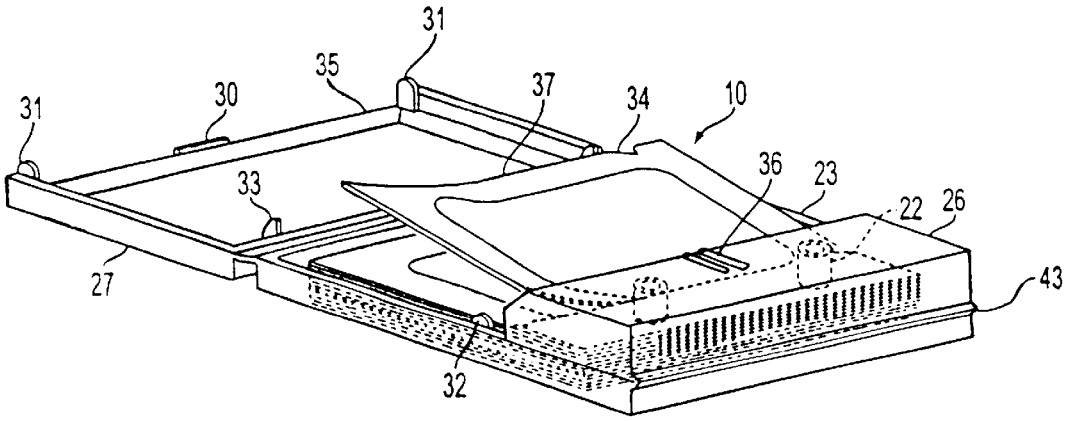
FIG. 5 is another perspective view of the container and packets depicted in FIG. 4, but with the pouch portion of the topmost packet being partially torn away from its tab portion.
Figure 11:
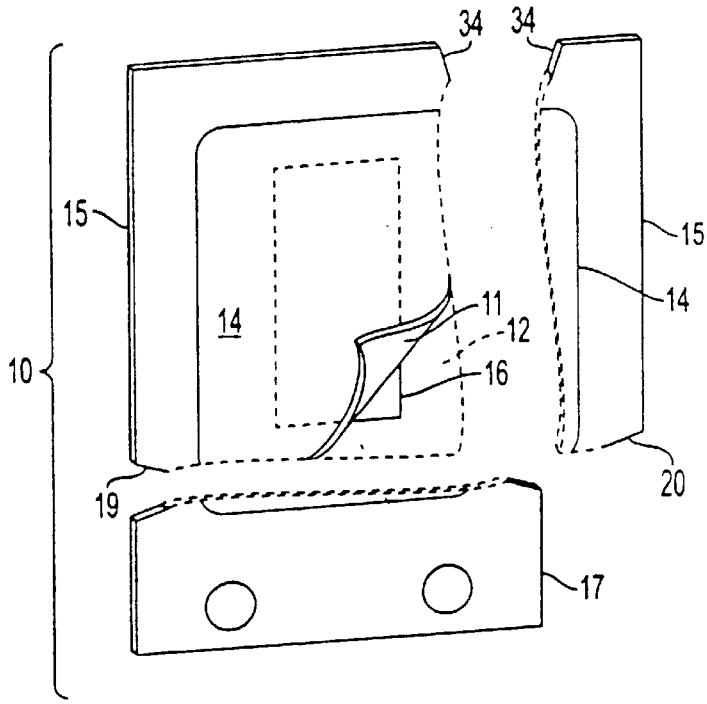
FIG. 11 is a perspective view of the pouch portion depicted in FIG. 10, showing it torn in two so as to better access the contents of the pocket.

When cover 27 is open, as shown in FIGS. 3–5, the pouch portion 15 of the topmost packet 10 can be gripped at its front edge 37 between thumb and forefinger, and pouch portion 15 can be torn away from tab portion 17, along tear line 21. This serves not only to remove pouch portion 15 from tray 23, but also to open one end of pocket 14, as illustrated in FIG. 11. If that opening is too short to permit easy removal of the strip 16, the pouch portion 15 may be torn into two segments using the tear-directing notch 34, as shown in FIG. 12. This results in opening pocket 14 along two adjacent edges, making strip 16 more accessible for removal.

Also, if the user prefers, the two tears can be made in reverse order. That is, pouch portion 15 can be torn from notch 34, as shown in FIG. 12, while packet 10 still is in its tray. Then the pouch portion can be torn away from tab portion 17 by tearing either from notch 19 or notch 20.

To help align movable cover 27 with fixed cover 26 when in the closed position, cover 27 is equipped with dogs 31, near the unhinged moving edge of cover 27. Dogs 31 nest behind corresponding dogs 32, which are integral with, and extend upwardly from, the inside walls of tray 23.

Figure 1:
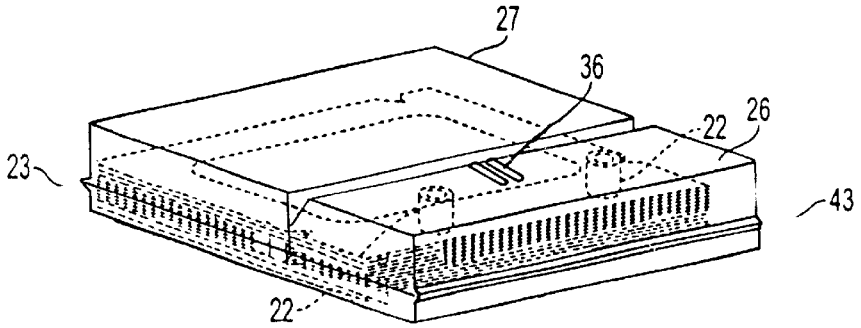
FIG. 1 is a perspective view that shows a closed container of the present invention with a stack of packets shown inside in phantom lines.
Figure 2:
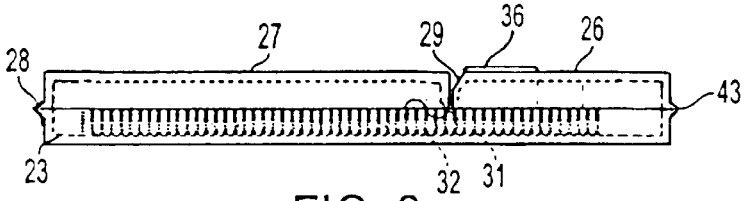
FIG. 2 is a side elevation view of the container and packets depicted in FIG. 1.
Figures 1, 12A:
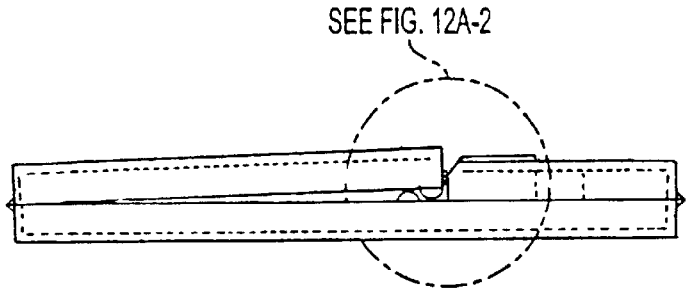
Figures 2, 12A:
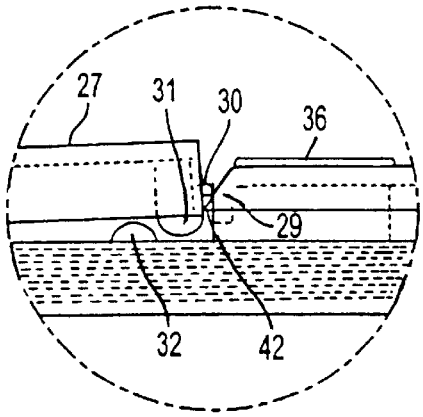
Figures 1, 12B:
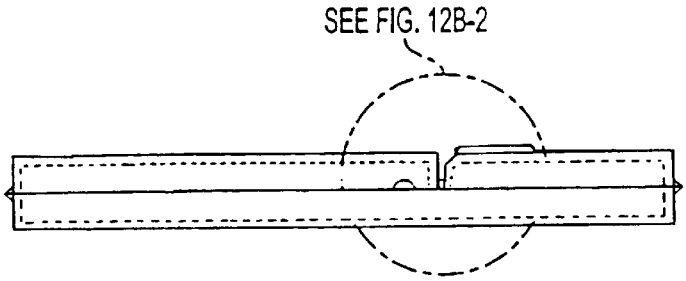
Figures 2, 12B:
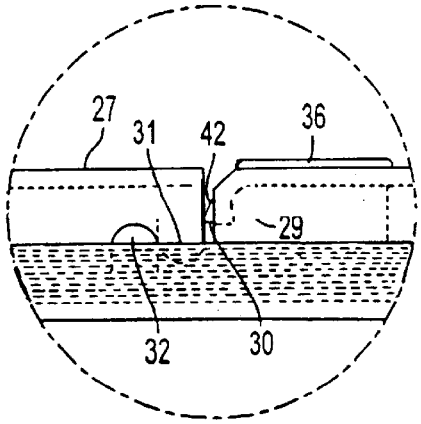

As shown in FIGS. 12A-1, A-2, B-1, and B-2, the mechanism for holding lid 27 closed is a combination of wedge-shaped overhang 42 that protrudes from the vertical front of down-turned lip 29, and tongue member 30 on movable lid 27. When lid 27 is forced into its closed position, tongue member 30 rides down and past overhang 42 and nests beneath overhang 42, as shown in FIG. 12B-2. The flexibility of the plastic of which the parts are made permits the tongue member 30 to be forced down and past overhang 42. Similarly, the flexibility of fixed cover 26 allows it to be pressed down by thumb pressure at the tread-like protrusions 36 with sufficient force to drive overhang 42 below tongue member 30, thereby releasing lid 27.

Figures 1, 13A:
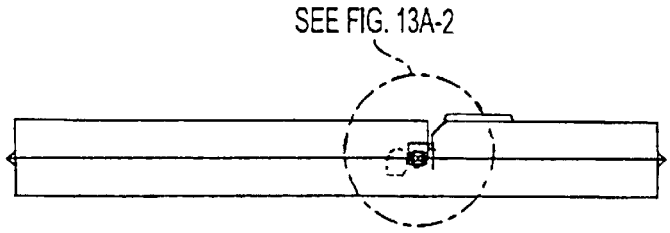
Figures 2, 13A:
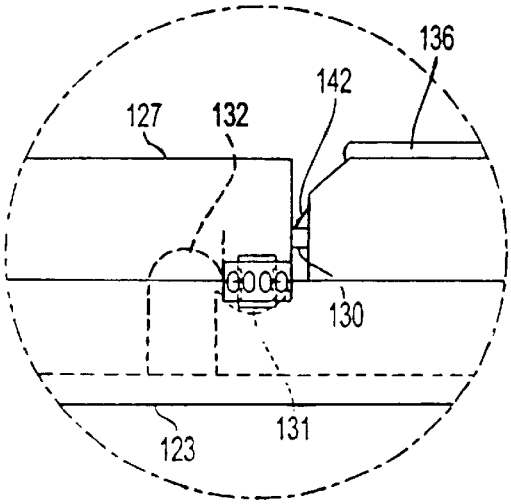
Figures 3, 13A:
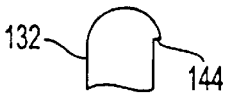
Figures 4, 13A:
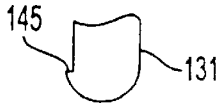
Figures 1, 13B:
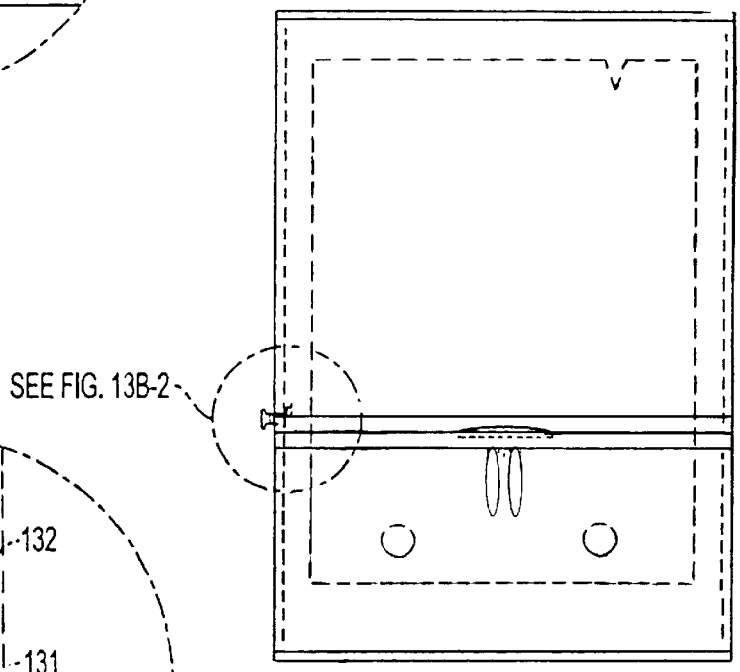
Figures 2, 13B:
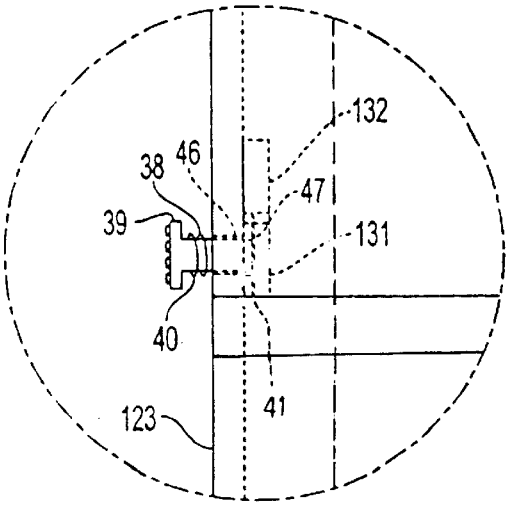
Figure 14A:
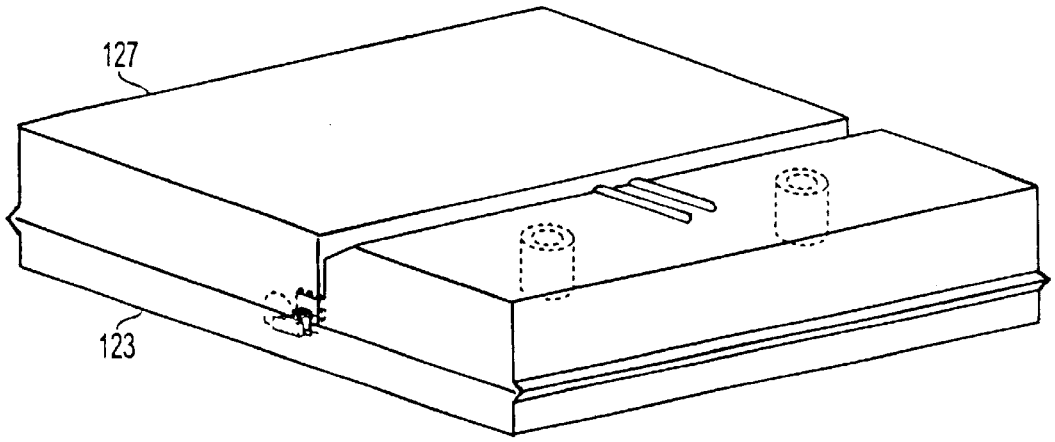
FIG. 14A is a perspective view of the container shown in FIG. 15, with the movable cover in the closed position.
Figures 1, 14B:
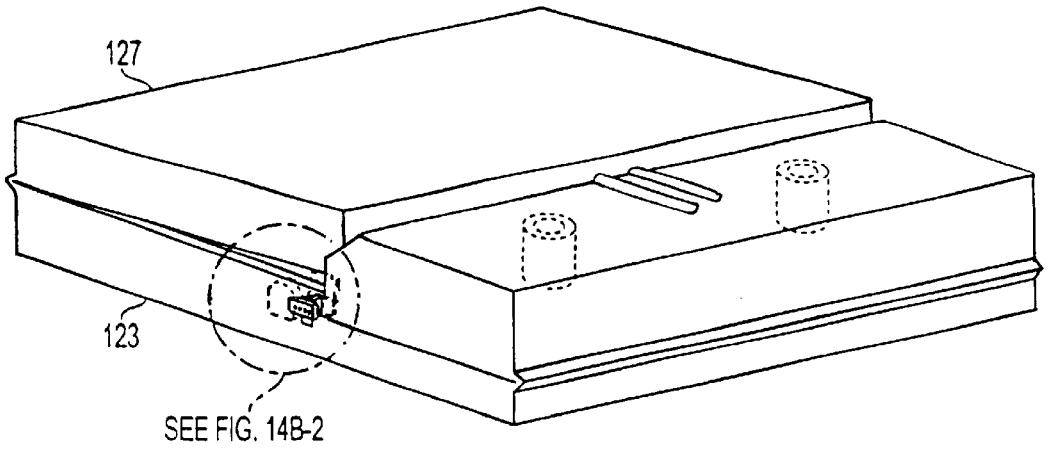
Figures 2, 14B:
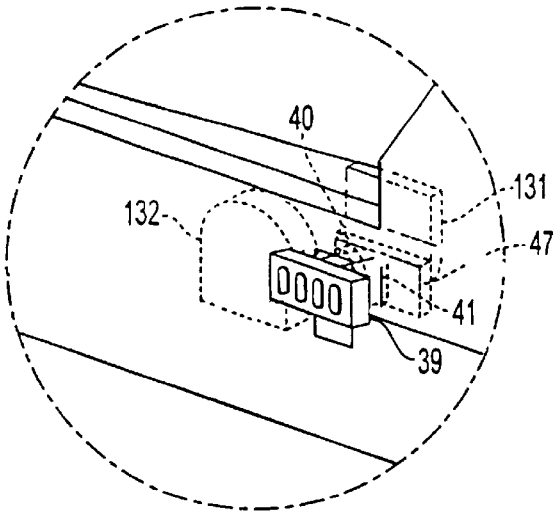

In the embodiment shown in FIGS. 13 and 14, dogs 131 and 132 have complementary undercuts 145 and 144, respectively, which cause dogs 131 and 132 to hook together, as shown in FIG. 13A-2, when movable cover 127 is closed. Dog 131 is sufficiently flexible, however, that it can be bent inward sufficiently far to cause it to unlatch from dog 132. Headed rectangular shaft 41 is held in hole 46 in the sidewall of tray 123. It is prevented from falling out by textured head 39 and foot plate 47. Coil spring 40 normally urges head 39 away from tray 123, thus allowing dog 131 to hook underneath undercut 144 of dog 132. To unlatch the mechanism, finger or thumb pressure can be applied to cap 39, as shown in FIGS. 14B-1 and 14B-2. This pushes the round bottom of dog 131 inward, sufficiently far to unhook from dog 132. If, at the same time, thumb or finger pressure is applied downwardly on protrusions 136, overhang 142 will be driven below tongue member 130, and cover 127 will pop open.

Figure 15:
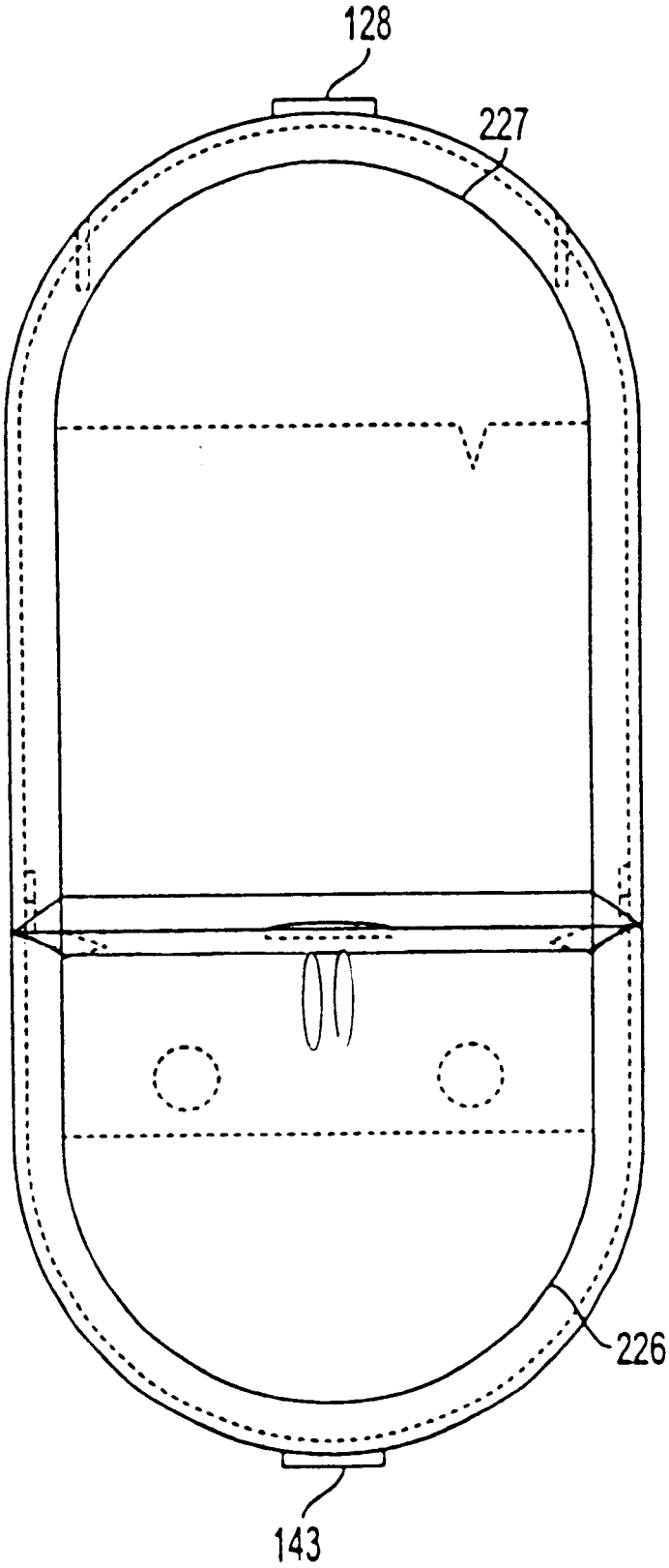
FIG. 15 is a top view of a third embodiment of the container and packets of the present invention.

In FIG. 15, the container is structured essentially the same as in FIG. 1, except that it is oval rather than rectangular. Living hinges 128 and 143 are appropriately shorter, to permit movable cover 227 to swing open and closed and to permit fixed cover 226 to be open for the loading of the packets into the container.

While the invention has been explained by a detailed description of certain specific embodiments of it, it is to be understood that various modifications and/or substitutions may be made without departing from the spirit of the invention. Accordingly, the invention should not be deemed limited by the detailed description of the embodiments set out above, but only by the following claims.

We claim:

1. A packaged supply of individual doses of a personal care product comprised of the combination of:

a) a tray;

b) a plurality of substantially identical packets uniformly stacked in said tray, each packet having a pouch portion that holds a single dose of the personal care product and a tab portion releasably connected to said pouch portion, the pouch portion having a front edge remote from the tab portion;

c) retention means for holding the tab portions of the stacked packets in the tray; and d) a cover that is movably connected to the tray, said cover being movable between a closed position in which the stack of packets is enclosed within the tray and an open position in which the pouch portion of the topmost packet on the stack is sufficiently exposed that its front edge can be gripped, allowing the pouch portion to be pulled away from the tab portion to which it is connected, thereby releasing that pouch portion from the tray.

2. The packaged supply of claim 1, wherein each packet is comprised of two flexible sheets that are partially laminated together so as to define a closed pocket between the sheets, in which pocket the dose is held.

3. The packaged supply of claim 1, wherein each packet's pouch portion and tab portion meet at a boundary zone along which the two portions can be torn apart by pulling on the pouch portion, thereby releasing the pouch portion from the tray.

4. The packaged supply of claim 3, wherein each packet's boundary zone has at least one tear-facilitating means that tends to confine the tear line to that zone when the pouch portion is torn away from the tab portion.

5. The packaged supply of claim 4, wherein a minor portion of each pocket extends into the packet's boundary zone, so that when the pouch portion is torn away from the tab portion along the boundary zone, the pocket is automatically opened along the tear line.

6. The packaged supply of claim 5, wherein the tear-facilitating means is selected from the group consisting of a score line, a perforated line, and a tear-directing notch in an edge of the packet, at an end of the boundary zone.

7. The packaged supply of claim 2, wherein each sheet is comprised of material that more easily tears in the direction of the boundary zone than in directions perpendicular thereto and comprises material selected from the group consisting of oriented film and striated film.

8. The packaged supply of claim 6, wherein the front edge of each pouch portion has second tear-facilitating means enabling the pouch portion to be manually torn into two segments along a second tear line that extends from the pouch's front edge to the tear line created when the pouch was pulled away from the tab portion, and further wherein each pocket straddles the second tear line, so that when the released pouch portion is torn in two along that line, the pocket is further opened, facilitating the removal therefrom of the dose.

9. The packaged supply of claim 8, wherein the second tear-facilitating means comprises a tear-directing notch in the front edge of the pouch.

10. The packaged supply of claim 1, wherein each packet is generally rectangular in shape.

11. The packaged supply of claim 1, wherein the personal care product that is held in the pouch portion comprises a water-soluble film that contains a pharmaceutically active substance.

12. The packaged supply of claim 6, wherein each packet has a tear-directing notch at each end of the boundary zone.

13. The packaged supply of claim 1, wherein the tray has two ends and the combination further comprises a fixed cover that covers one tray end and has a free edge that is intermediate the two ends of the tray, wherein the tab portions of the stacked packets and the tab portion retention means both lie underneath said fixed cover, wherein the movable cover is hingedly connected to the tray so that, when it is in its closed position, an edge of the movable cover rests against the free edge of the fixed cover, and wherein the combination further includes latch means for releasably holding the movable cover in the closed position.

14. The packaged supply of claim 13, wherein the latch means can be released by pressing down on a portion of the fixed over, which causes the movable cover to pop open.

15. The packaged supply of claim 14, wherein the latch means comprises an interference fit between the movable cover and the fixed cover which is engaged by pressing the movable cover into its closed position.

16. The packaged supply of claim 15, further comprising an elongate, downward-protruding crest member on the underside of the fixed cover, located above and substantially parallel to the boundary zone of the topmost packet on the stack, and wherein the fixed cover is sufficiently flexible that by thumb pressure on the top thereof the crest member can be pressed against the stack of packets, at the boundary zone, thereby helping to deter the tear line from straying into the tab portion of a packet when the pouch portion is being torn away from that tab portion.

17. The packaged supply of claim 3, wherein the retention means comprises at least one means selected from the group consisting of (a) a combination of two posts in the tray and corresponding holes in each tab portion, with the tab portion being mounted on the posts, (b) glue, (c) adhesive tape, and (d) a combination of a depressible fixed cover over the tray end where the tabs are located and an elongate, downward-protruding crest member on the underside of the cover, located above and substantially parallel to the boundary zone of the topmost packet, the cover being sufficiently flexible that by thumb pressure on the top thereof, the crest member can be pressed against the stack of packets, at the boundary zone, and held there while the pouch portion is torn away.

18. The packaged supply of claim 1, wherein the retention means comprise two posts, each packet's tab portion has two holes therein that fit over the posts, and all of the packets are mounted on the two posts.

19. The packaged supply of claim 1, wherein the top surface of the pouch portion of each packet is imprinted with the name of the personal care product and wherein the movable cover is transparent, allowing the name of the personal care product to be read off the pouch portion of the topmost packet when the movable cover is in either the closed or the open position.

20. The packaged supply of claim 13, wherein the latch means has to be pressed to release it, and wherein the combination further includes second latch means that has to be simultaneously pressed, in order to open the movable cover.

* * * * *